US008313172B2

(12) United States Patent
Miyata

(10) Patent No.: US 8,313,172 B2
(45) Date of Patent: Nov. 20, 2012

(54) LIQUID EJECTION HEAD WIRING MEMBER AND LIQUID EJECTION HEAD

(75) Inventor: Yoshinao Miyata, Matsukawa-mura (JP)

(73) Assignee: Seiko Epson Corporation, Tokyo (JP)

( * ) Notice: Subject to any disclaimer, the term of this patent is extended or adjusted under 35 U.S.C. 154(b) by 98 days.

(21) Appl. No.: 13/029,321

(22) Filed: Feb. 17, 2011

(65) Prior Publication Data

US 2011/0205308 A1 Aug. 25, 2011

(30) Foreign Application Priority Data

Feb. 19, 2010 (JP) ..... 2010-034387

(51) Int. Cl.

| | |
|---|---|
| ***B41J 2/045*** | (2006.01) |
| ***B41J 2/14*** | (2006.01) |
| ***B41J 2/16*** | (2006.01) |
| ***B41J 2/05*** | (2006.01) |

(52) U.S. Cl. ..... 347/68; 347/50; 347/58

(58) Field of Classification Search ..... None
See application file for complete search history.

(56) References Cited

U.S. PATENT DOCUMENTS

2005/0001881 A1 * 1/2005 Nakashima et al. ..... 347/50

FOREIGN PATENT DOCUMENTS

JP 2005-254616 9/2005

* cited by examiner

*Primary Examiner* — Matthew Luu
*Assistant Examiner* — Lisa M Solomon
(74) *Attorney, Agent, or Firm* — Workman Nydegger

(57) ABSTRACT

The first and second cables overlap with each other while at an attitude where the wiring terminal formation surfaces face the same side, and the one-end-side common wiring terminal is located on the outside of the arrangement direction of the wiring terminals of the group of the one-end-side individual electrode wirings. The one end portions of the first and second cables are bent in the same direction so that the wiring terminals respectively face element terminals of piezoelectric elements, and the wiring terminals are respectively bonded to the corresponding element terminals.

11 Claims, 8 Drawing Sheets

LIQUID EJECTION HEAD WIRING MEMBER AND LIQUID EJECTION HEAD

The entire disclosure of Japanese Patent Application No: 2010-034387, filed Feb. 19, 2010 are expressly incorporated by reference herein.

BACKGROUND

1. Technical Field

The present invention relates to a wiring member used in a liquid ejecting head such as an ink jet printing head and a liquid ejecting head having the same, and particularly, to a liquid ejecting head wiring member having wiring terminal rows formed by arranging wiring terminals respectively corresponding to pressure generating elements of a liquid ejecting head and a liquid ejecting head having the same.

2. Related Art

As one type of liquid ejecting head that ejects a liquid droplet from a nozzle by causing a variation in pressure of a liquid inside a pressure chamber, a liquid ejecting head configured to eject a liquid droplet by deforming a piezoelectric element (which is one kind of pressure generating element) bonded to a vibration plate is known. In this liquid ejecting head, the volume of the pressure chamber changes by driving the piezoelectric element in accordance with the application of the driving voltage (the driving pulse), the pressure of the liquid stored inside the pressure chamber changes, and then the liquid droplet is ejected from the nozzle by using a variation in the pressure.

A film-shaped wiring member (hereinafter, referred to as a flexible cable) such as a COF (Chip On Film) or a TCP (Tape Carrier Package) having an IC installed thereon to drive the piezoelectric element is electrically connected to the piezoelectric element, and a driving voltage is supplied via the flexible cable (for example, refer to JP-A-2005-254616). The piezoelectric element includes a lower electrode film, a piezoelectric body layer, and an upper electrode film. Generally, one electrode (for example, the lower electrode film) is used as a common element electrode commonly used with a plurality of piezoelectric elements, and the other electrode (for example, the upper electrode film) is used as an individual element electrode individually patterned for each of the piezoelectric elements. The piezoelectric body layer interposed between the common element electrode and the individual element electrode is a piezoelectric body activating portion that undergoes piezoelectric strain in accordance with the application of a driving voltage between both electrodes.

FIG. 7 is a schematic diagram illustrating a layout of an element electrode wiring portion (a lead electrode portion) extending from an element electrode and an element electrode of a piezoelectric element of an actuator unit 69 (refer to FIG. 8) of an existing printing head. Further, in the same drawing, the dark hatching portion indicates an individual element electrode and an individual element electrode wiring portion electrically connected thereto, and the light hatching portion indicates a common element electrode and a common element electrode wiring portion electrically connected thereto. Furthermore, in the same drawing, the vertical direction is the nozzle arrangement direction (the arrangement direction of the piezoelectric elements). A pressure chamber and a piezoelectric element are formed so as to correspond to each of the nozzles, and in the same drawing, only two rows of nozzles are shown.

In the configuration shown in the drawing, common element electrodes 70 commonly used with the piezoelectric elements are continuously formed on an elastic film (not shown) defining a part of the pressure chamber in the nozzle row direction, and an piezoelectric body layer (not shown) and an individual element electrode 71 are sequentially laminated thereon so as to be patterned for each of the piezoelectric elements. An individual element electrode terminal 72 (which is one kind of individual element electrode wiring portion) is formed between the adjacent nozzle rows while being electrically connected to the electrode 71 so as to correspond to each of the individual element electrodes 71. An individual element electrode terminal 72*a* corresponding to one nozzle row (on the left side of the drawing) and an individual element electrode terminal 72*b* corresponding to the other nozzle row (on the right side of the drawing) are arranged in a row shape so as to deviate from each other in the nozzle row direction. The individual element electrode terminal 72 is a portion that is electrically connected to a one-end-side individual electrode wiring terminal 77 (refer to FIG. 8) of a flexible cable 68.

Further, a common element electrode portion 73 (which is one kind of common element electrode wiring portions) is formed so as to surround the common element electrode 70, the individual element electrode 71, and the individual element electrode terminal 72. The common element electrode portion 73 is formed in a frame shape including a common vertical electrode portion 73*a* which extends in the nozzle row direction on the outside of the nozzle row direction (the opposite side of the individual element terminal formation side) of each of the nozzle rows, and a common transverse electrode portion 73*b* which extends in a direction perpendicular to the nozzle row direction on both sides of the nozzle row direction. The common element electrode portion 73 is electrically connected to each of the common element electrodes 70 via a branch electrode portion 74. In addition, a portion located on both sides in the arrangement direction of the individual element electrode terminal 72, that is, a portion surrounded by the dashed circle in the drawing in the common element electrode portion 73 is a common element electrode terminal 75 that is bonded to the common electrode wiring terminal 78 of the flexible cable.

As shown in FIG. 8, the flexible cable 68 has a configuration in which a control IC 76 is mounted on a surface of a base film such as polyimide so as to control the driving voltage applied to the piezoelectric element, a wiring pattern (not shown) of the individual electrode wiring or the common electrode wiring is formed thereon, and then the control IC 76 or the wiring pattern other than the wiring terminal (the individual electrode wiring terminal 77 and the common electrode wiring terminal 78) is covered by a resist. Further, a plurality of the one-end-side individual electrode wiring terminals 77 is formed at one end portion of the flexible cable so as to respectively correspond to the individual element electrode terminals 72 of the actuator unit. Furthermore, the one-end-side common electrode wiring terminal 78 is formed on the outside of the arrangement direction of the one-end-side individual electrode wiring terminal group at the one end portion so as to correspond to the common element electrode terminal 75 of the actuator unit. In addition, one end portion of the flexible cable is bent at a substantially right angle toward the opposite side of the surface provided with the wiring pattern and the like between the wiring terminal formation area and the wiring pattern formation area. Each of the wiring terminals 77 and 78 is subjected to solder plating in advance, the wiring terminals 77 and 78 are soldered to the corresponding element terminals 71 and 75 on the side of the actuator unit so as to be electrically connected thereto, and then the flexible cable 68 is attached to the actuator unit 69.

However, in existing printing heads, as described above, the common electrode wiring, the individual electrode wiring, the wiring terminals, and the driving control IC are provided on one flexible cable, and the proportion of the area provided with the common electrode wiring becomes smaller than that of the area of the driving control IC or the individual electrode wiring due to the limitation in the installation space. Then, when the wiring space involved with the common electrode is narrow due to the common element electrode wiring portion of the actuator unit, a decrease in the voltage occurs within the plane of the electrode in accordance with the resistance of the electrode, and the driving voltage applied to the piezoelectric element becomes irregular. Accordingly, there is concern that the weight or the flight speed of the ink ejected from the nozzle may become irregular. Particularly, the possibility of causing the above-described inconvenience increases as the number of nozzles simultaneously ejecting the ink increases. In order to suppress this inconvenience, existing printing heads require a larger area for the common element electrode wiring portion in the actuator unit, and a decrease in the size of the printing head by the amount of the increased area is not easily realized.

SUMMARY

An advantage of some aspects of the invention is that it provides a liquid ejecting head wiring member capable of contributing to a decrease in the size of a liquid ejecting head and a liquid ejecting head having the same.

According to an aspect of the invention, there is provided a liquid ejecting head wiring member that supplies a driving voltage to an actuator unit of a liquid ejecting head which includes a plurality of pressure generating elements ejecting a liquid from a nozzle communicating with a pressure chamber by causing a variation in the pressure of the liquid inside the pressure chamber in accordance with the application of the driving voltage between an individual element electrode and a common element electrode, the liquid ejecting head wiring member including: a first wiring member which includes a plurality of one-end-side individual electrode wiring terminals formed at one end portion thereof so as to respectively correspond to the individual element electrode terminals of the pressure generating elements and individual electrode wirings formed so as to respectively correspond to the individual electrode wiring terminals; and a second wiring member which includes one-end-side common electrode wiring terminals formed at one end portion thereof so as to respectively correspond to common element electrode terminals of the pressure generating elements and common electrode wirings formed so as to respectively correspond to the one-end-side common electrode wiring terminals, and has a width in the direction corresponding to the arrangement direction of the individual electrode wiring terminals larger than that in the arrangement direction of the individual electrode wiring terminals of the first wiring member, wherein the first wiring member and the second wiring member overlap with each other so that wiring terminal formation surfaces face the same side and the one-end-side common electrode wiring terminals are located on the outside of the arrangement direction of the wiring terminals of the group of the one-end-side individual electrode wiring terminals, one end portions thereof are bent in the same direction so that the wiring terminals respectively face the element terminals of the pressure generating elements, and then the wiring terminals are respectively bonded to the corresponding element terminals.

According to this configuration, since only the common electrode wiring is formed in the second wiring member from between the first and second wiring members, it is possible to secure a larger formation area of the common electrode wiring than that of existing wiring members. Since it is possible to reduce the area of the common element electrode wiring portion on the pressure generating elements by as much as the secured area, it is possible to contribute to a decrease in the size of the liquid ejecting head.

In the above-described configuration, the second wiring member may include a one-end-side notch portion which is formed at a position away from the one-end-side common electrode wiring terminals at the one end portion so as to be partially notched from the one end side toward the other end side, and the group of the one-end-side individual electrode wiring terminals may be disposed inside the one-end-side notch portion while the first and second wiring members overlap with each other.

According to this configuration, since it is possible to arrange the group of the one-end-side individual electrode wiring terminals and the one-end-side common electrode wiring terminal on the same row while the first and second wiring members overlap with each other, it is possible to simply and simultaneously perform the bonding of each wiring terminal and the element terminal on the side of the pressure generating element. Further, since it is possible to prevent one end portion of the first wiring member from overlapping with one end portion of the second wiring member, it is possible to easily bend the first and second wiring members during the wiring operation.

In the above-described configuration, the other end portion of the first wiring member may be provided with a plurality of the other-end-side individual electrode wiring terminals. The other end portion of the second wiring member may be provided with the other-end-side common electrode wiring terminal and the other-end-side notch portion which is formed at a position away from the other-end-side common electrode wiring terminal so as to be partially notched from the other end side toward the one end side. The group of the other-end-side individual electrode wiring terminals may be disposed in the other-end-side notch portion while the first and second wiring members overlap with each other.

According to this configuration, since it is possible to arrange the group of the other-end-side individual electrode wiring terminals and the other-end-side common electrode wiring terminal on the same row while the first and second wiring members overlap with each other, it is possible to simply and simultaneously perform bonding of each wiring terminal and the terminal on the side of the driving substrate. Further, since it is possible to prevent the other end portion of the first wiring member from overlapping with the other end portion of the second wiring member, it is possible to easily bend the first and second wiring members during the wiring operation.

According to another aspect of the invention, there is provided a liquid ejecting head that applies a driving voltage to a pressure generating element via the liquid ejecting head wiring member according to the above-described aspect, the liquid ejecting head including: an actuator unit which includes a plurality of the pressure generating elements ejecting a liquid from a nozzle communicating with a pressure chamber by causing a variation in the pressure of the liquid inside the pressure chamber in accordance with the application of the driving voltage between an individual element electrode and a common element electrode; an individual element electrode connection portion which is electrically connected to the individual element electrode; and a common element electrode connection portion which is electrically connected to the common element electrode, wherein the individual element electrode connection portion is connected to an individual electrode wiring terminal corresponding to the first wiring member, and wherein the common element electrode connection portion is connected to a common electrode wiring terminal corresponding to the second wiring member.

According to the aspect of the invention, since it is possible to secure a larger pattern formation area of the common electrode wiring of the wiring member than that of existing wiring members, it is possible to reduce the area of the common element electrode wiring portion on the side of the pressure generating element by as much as the secured area, and thus to contribute to a decrease in the size of the liquid ejecting head.

Further, according to still another aspect of the invention, there is provided a liquid ejecting apparatus including the liquid ejecting head according to the above-described aspect. According to the aspect, it is possible to provide a liquid ejecting apparatus that contributes to a decrease in the size.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an exemplary embodiment of the invention will be described with reference to the accompanying drawings. Further, in the embodiments to be described later, various embodiments are described as preferred examples of the invention, but the scope of the invention is not limited to the embodiments as long as no particular remark is made in the description below. In addition, in the description below, an ink jet printing head (hereinafter, simply referred to as a printing head) mounted in an ink jet printer (which is one kind of liquid ejecting apparatus according to the invention) will be exemplified as a liquid ejecting head of the invention.

Figure 1:
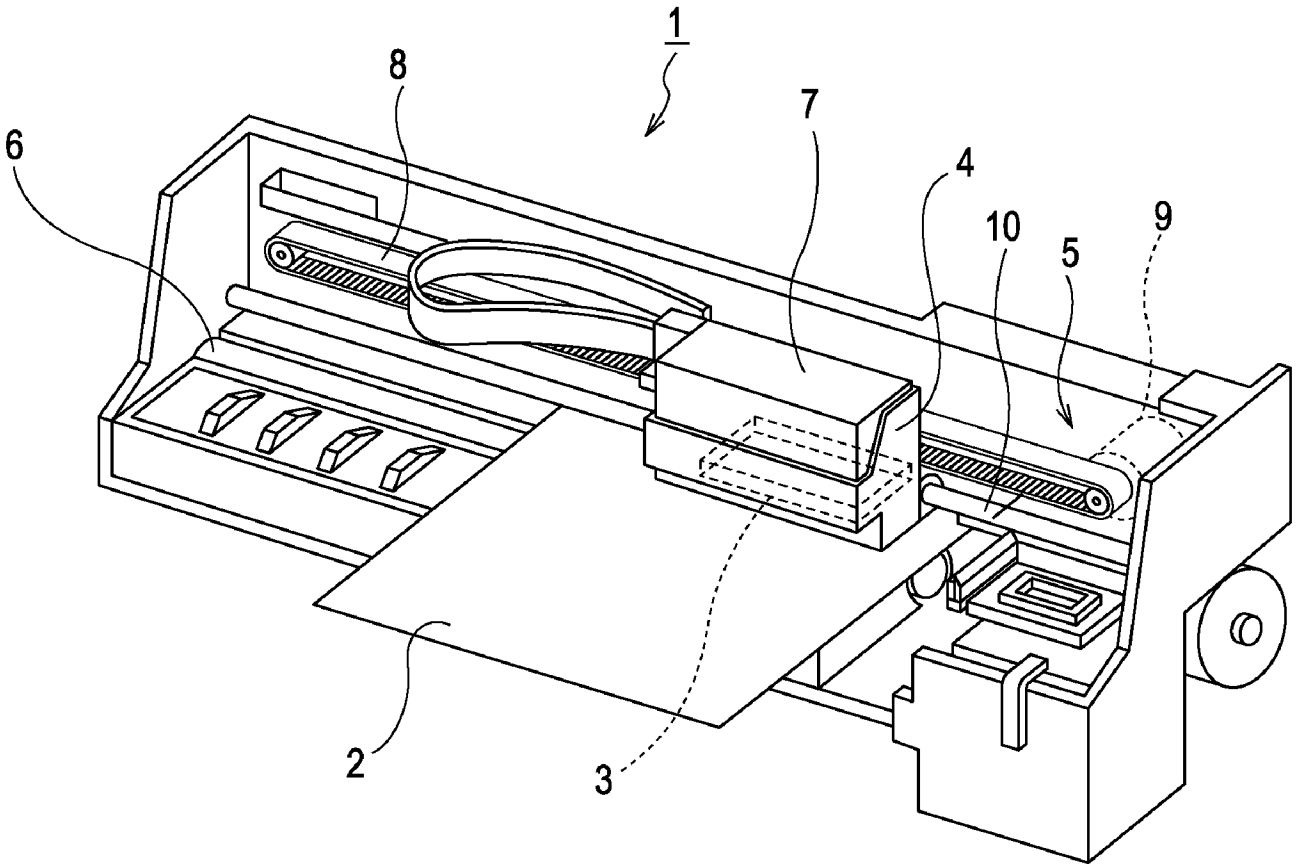
FIG. 1 is a perspective view illustrating a configuration of a printer.

First, a schematic configuration of the printer will be described with reference to FIG. 1. A printer 1 is an apparatus that prints an image or the like on a surface of a printing medium 2 such as a printing sheet by ejecting a liquid ink thereto. The printer 1 includes a printing head 3 which ejects the ink, a carriage 4 to which the printing head 3 is attached, a carriage movement mechanism 5 which moves the carriage 4 in the primary scanning direction, a platen roller 6 which transports the printing medium 2 in the secondary scanning direction, and the like. Here, the ink is one kind of liquid according to the invention, and is stored in an ink cartridge 7. The ink cartridge 7 is detachably attached to the printing head 3. In addition, a configuration may be adopted in which the ink cartridge 7 is disposed on the body of the printer 1, and the ink is supplied from the ink cartridge 7 to the printing head 3 via an ink supply tube.

The carriage movement mechanism 5 includes a timing belt 8. Then, the timing belt 8 is driven by a pulse motor 9 such as a DC motor. Accordingly, when the pulse motor 9 is operated, the carriage 4 is guided by a guide rod 10 installed in the printer 1, and moves in a reciprocating manner in the primary scanning direction (the width direction of the printing medium 2).

Figure 2:
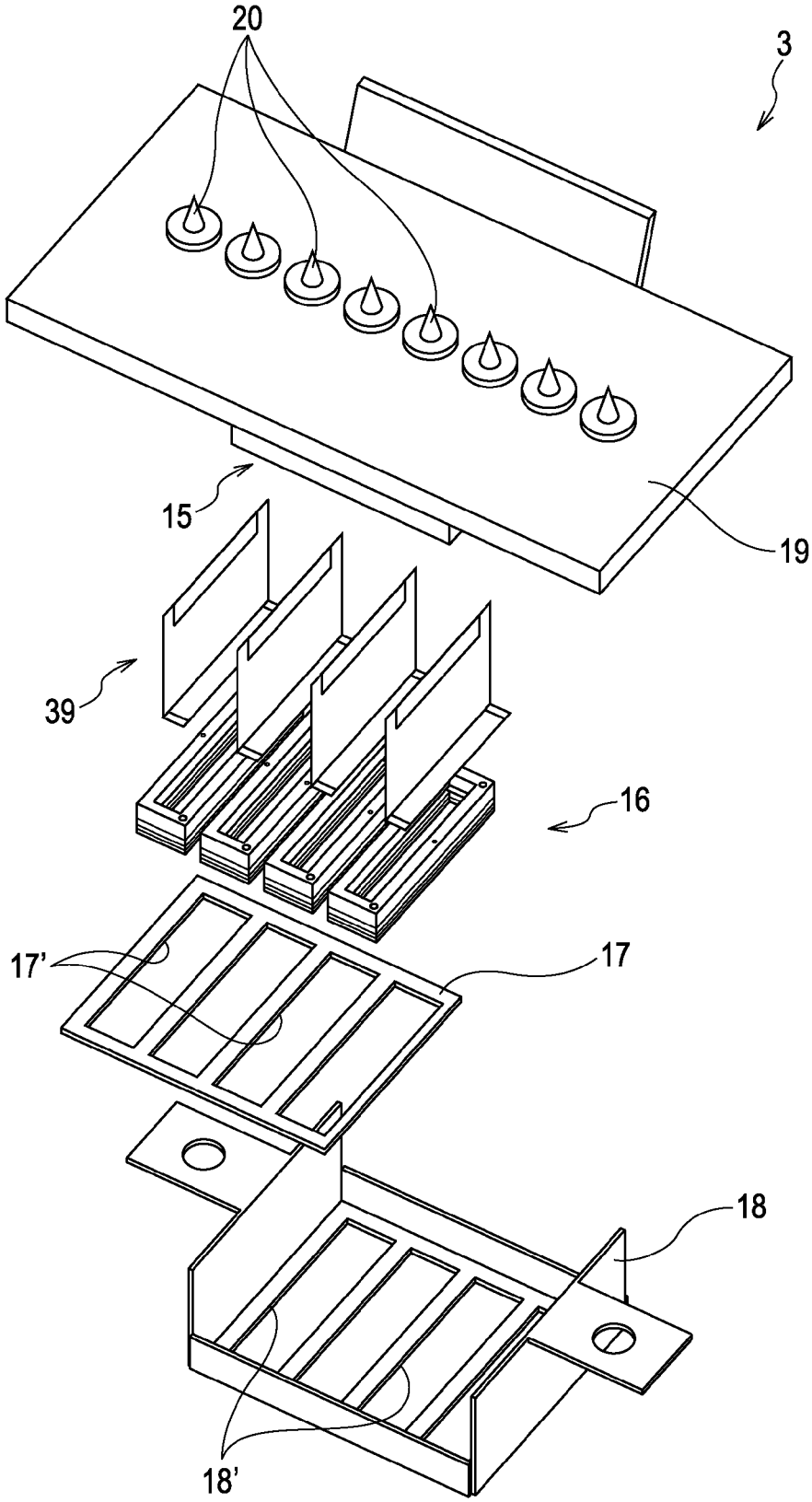
FIG. 2 is an exploded perspective view illustrating a printing head when obliquely seen from the upside thereof.

FIG. 2 is an exploded perspective view illustrating a configuration of the printing head 3. The printing head 3 of the embodiment schematically includes a casing 15, a plurality of head units 16, a unit fixation plate 17, and a head cover 18.

The casing 15 is a box-shaped member which accommodates therein the head unit 16 or a collection channel (not shown), and has a needle holder 19 formed on the upper surface thereof. The needle holder 19 is a plate-shaped member which is used to attach ink introduction needles 20 thereto, and in the embodiment, eight ink introduction needles 20 are uniformly disposed on the needle holder 19 so as to correspond to the ink colors of the ink cartridge 3. Each of the ink introduction needles 20 is a hollow-needle-shaped member which is inserted into the ink cartridge 3, and introduces the ink stored inside the ink cartridge 3 from an introduction hole (not shown) installed in the front end portion thereof to the head unit 16 via the collection channel inside the casing 15.

In addition, at the bottom surface of the casing 15, four head units 16 are attached to a metallic unit fixation plate 17 having four opening portions 17' respectively corresponding to the head units 16 uniformly positioned in the primary scanning direction, and are fixed by a metallic head cover 18 having four opening portions 18' respectively corresponding to the head units 16.

Figure 3:
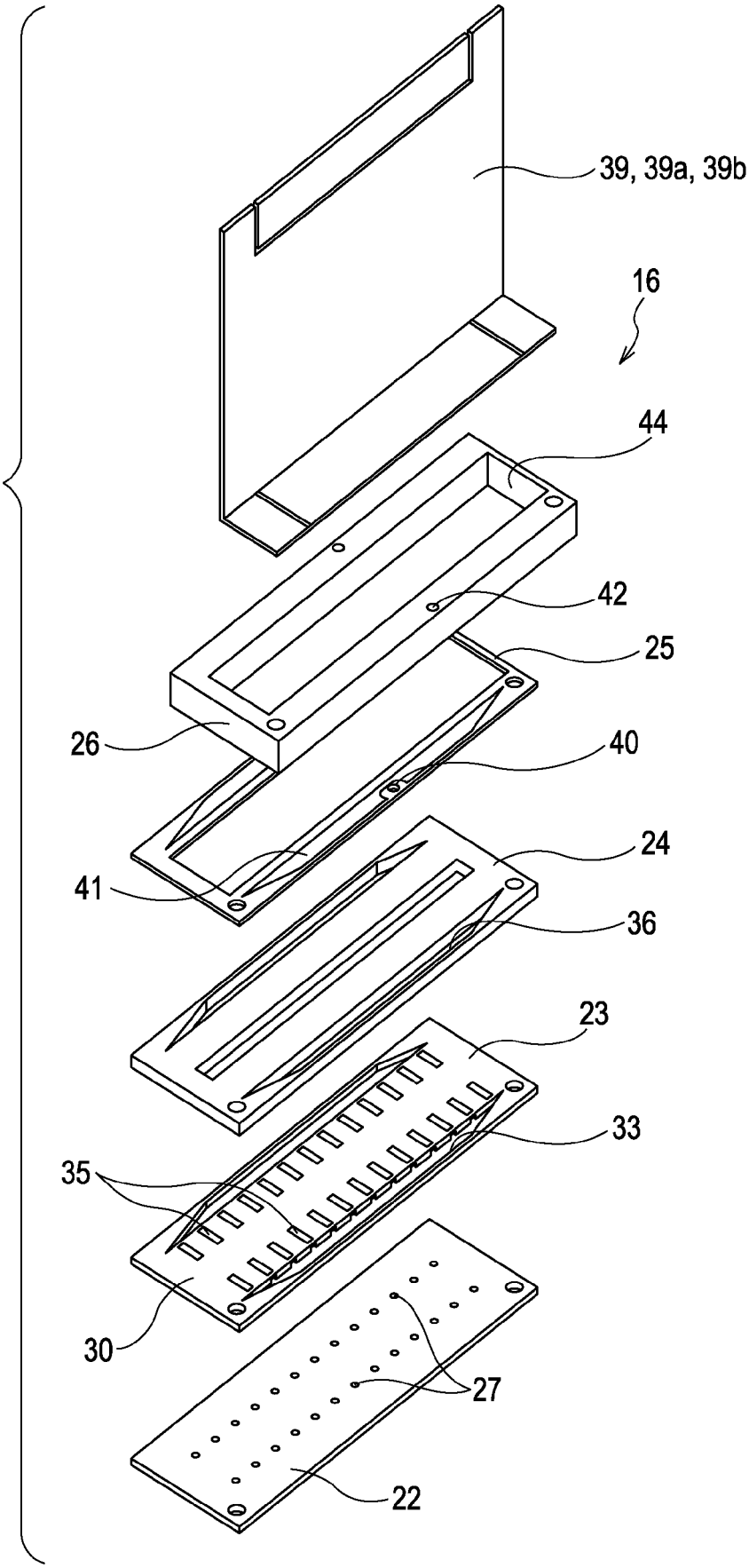
FIG. 3 is an exploded perspective view illustrating a head unit.
Figure 4:
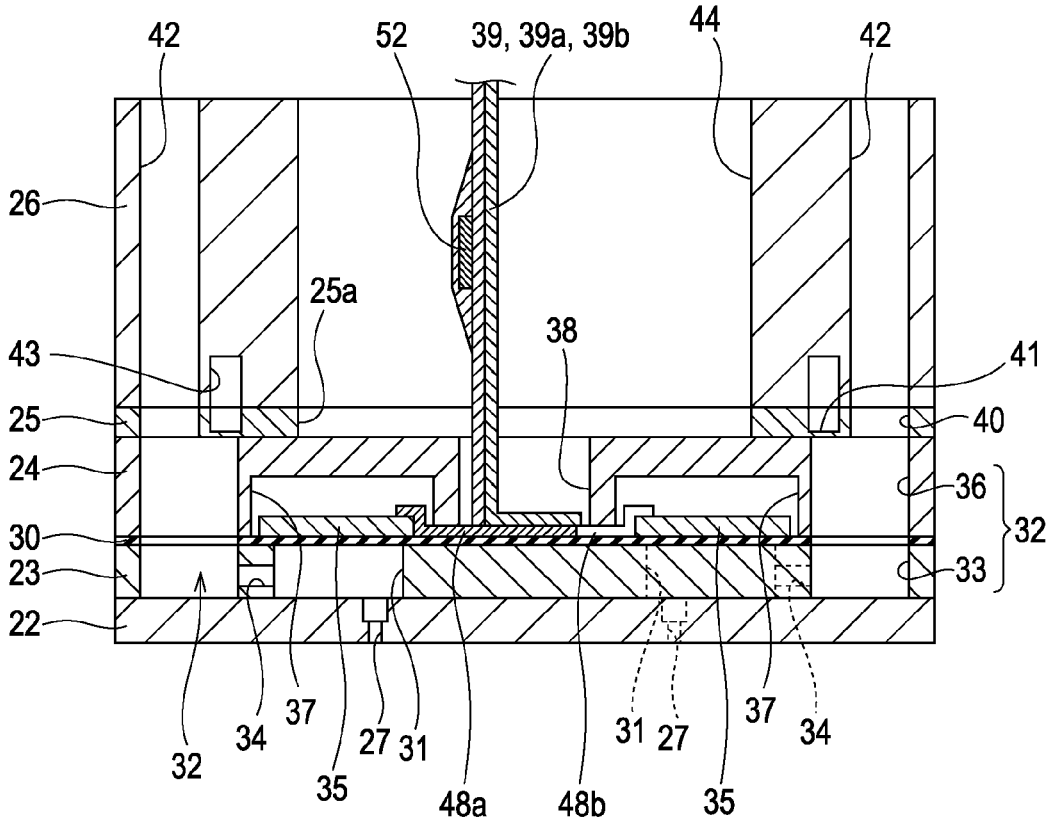
FIG. 4 is a cross-sectional view illustrating the head unit.

FIG. 3 is an exploded perspective view illustrating a configuration of the head unit 16, and FIG. 4 is a cross-sectional view illustrating the head unit 16 (the liquid ejecting head constituting the printing head 3). In addition, for convenience of description, the lamination direction of the respective members will be described as the vertical direction.

The head unit 16 of the embodiment schematically includes a nozzle plate 22, a channel substrate 23, a common liquid chamber substrate 24, and a compliance substrate 25, and the laminated structure thereof is attached to a unit casing 26.

The nozzle plate 22 (which is one kind of nozzle formation member) is a plate-shaped member having a plurality of nozzles 27 uniformly formed at the pitch corresponding to the dot formation density. In the embodiment, the nozzle row (which is one kind of nozzle group) is formed by arranging three hundred nozzles 27 at the pitch corresponding to 300 dpi. In the embodiment, two nozzle rows are formed on the nozzle plate 22.

The channel substrate 23 is formed so that an extremely thin elastic film 30 formed of silicon dioxide is provided on the upper surface thereof (the surface on the side of the common liquid chamber substrate 24) by thermal oxidation. As shown in FIG. 4, the channel substrate 23 has a plurality of pressure chambers 31 formed thereon so as to respectively correspond to the nozzles 27, where the pressure chambers are defined by a plurality of partition walls through anisotropic etching. A communication hole portion 33 is formed on the outside of the row of the pressure chambers 31 in the channel substrate 23 so as to define a part of the common liquid chamber 32. The communication hole portion 33 communicates with each of the pressure chambers 31 via an ink supply path 34.

A piezoelectric element 35 (which is one kind of pressure generating element of the invention) is formed on the elastic film 30 on the upper surface of the channel substrate 23 so as to correspond to each of the pressure chambers 31, where the piezoelectric element is formed by sequentially laminating a metallic lower electrode film (a common element electrode 46), a piezoelectric body layer (not shown) formed of lead zirconate titanate (PZT) and the like, and an upper electrode film (an individual element electrode 47) which is formed of metal. The piezoelectric element 35 is a so-called flexible mode piezoelectric element, and is formed so as to cover the upper portion of the pressure chamber 31. In the embodiment, two rows of piezoelectric elements (which is a pressure generating element group of the invention) corresponding to two rows of nozzles are arranged in a direction perpendicular to the nozzle rows so that the piezoelectric elements 35 deviate from each other when seen from the nozzle row direction. In addition, a configuration may be adopted in which the lower electrode film is the individual element electrode 47, and the upper electrode film is the common element electrode 46.

Electrode wiring portions 48 and 49 respectively extend from the element electrodes 47 and 46 of the piezoelectric element 35 to the surface of the elastic film 30, and the portions corresponding to the electrode terminals of the electrode wiring portions are electrically connected to wiring terminals 53 and 57 of a flexible cable 39. Then, each of the piezoelectric elements 35 is formed to be deformed when a driving voltage is applied between the individual element electrode and the common element electrode via the flexible cable 39. In the embodiment, the elastic film 30, the piezoelectric element 35 including the electrodes 46 and 47, and the electrode wiring portions 48 and 49 electrically connected to the electrodes of the piezoelectric elements 35 correspond to an actuator unit. In addition, the electrode wiring portion or the flexible cable 39 will be described later in detail.

The common liquid chamber substrate 24 (the protection substrate) having a perforation hole portion 36 formed in the thickness direction is disposed on the channel substrate 23 provided with the piezoelectric element 35. The common liquid chamber substrate 24 is formed by using a silicon single crystal substrate as in the channel substrate 23 or the nozzle plate 22. Further, the perforation hole portion 36 in the common liquid chamber substrate 24 defines a part of the common liquid chamber 32 while communicating with the communication hole portion 33 of the channel substrate 23. In addition, a piezoelectric element accommodating hole portion 37 is formed in an area facing the piezoelectric element 35 in the common liquid chamber substrate 24 so as to have a size not disturbing the driving of the piezoelectric element 35. Further, a wiring hole portion 38 is formed in the thickness direction of the substrate between the adjacent rows of the piezoelectric elements in the common liquid chamber substrate 24. The individual element electrode terminal 48 of the piezoelectric element 35, the common element electrode terminal 51 (refer to FIG. 5), or the like is disposed inside a wiring hole portion 38 in a plan view.

Further, the compliance substrate 25 is disposed on the upper surface of the common liquid chamber substrate 24. An ink introduction opening 40 is formed in the thickness direction in an area facing the perforation hole portion 36 of the common liquid chamber substrate 24 in the compliance substrate 25 so as to supply the ink on the side of the ink introduction needle 20 to the common liquid chamber 32. Further, the area other than a perforation opening 25*a* to be described later and the ink introduction opening 40 of the area facing the perforation hole portion 36 of the compliance substrate 25 is formed as an extremely thin flexible portion 41, and the common liquid chamber 32 is defined by sealing the upper opening of the perforation hole portion 36 by using the flexible portion 41. Then, the flexible portion 41 serves as a compliance portion that absorbs a variation in the pressure of the ink inside the common liquid chamber 32. Further, a perforation opening 25*a* is formed at the center portion of the compliance substrate 25. The perforation opening 25*a* communicates with a hole portion 44 of the unit casing 26.

The unit casing 26 is a member that has an ink introduction path 42 for supplying the ink introduced from the ink introduction needle 20 while communicating with the ink introduction opening 40 to the common liquid chamber 32, and a concave portion 43 for permitting the expansion of the flexible portion 41 in an area facing the flexible portion 41. The hole portion 44 is formed in the thickness direction at the center portion of the unit casing 26, and one end side of the flexible cable 39 is inserted through the hole portion 44 so as to be connected to the element electrode terminal of the actuator unit.

In addition, the nozzle plate 22, the channel substrate 23, the common liquid chamber substrate 24, the compliance substrate 25, and the unit casing 26 are laminated with a heat welding film or adhesive interposed therebetween, and are heated so as to be bonded to each other.

The printing head 3 having the head unit 16 with the above-described configuration is attached to the carriage 4 so that the nozzle row direction is aligned with the secondary scanning direction while each of the nozzle plates 22 faces the platen 5. Then, each of the head units 16 receives the ink from the ink cartridge 3 to the common liquid chamber 32 via the ink introduction opening 40 and the ink introduction path 42, and fills the ink in the ink channel (which is one kind of liquid channel) provided from the common liquid chamber 32 to the nozzle 27. Then, the driving voltage is supplied from the flexible cable 39 to the piezoelectric element 35 so as to bend the piezoelectric element 35. Accordingly, the pressure of the ink inside the corresponding pressure chamber 31 changes, and the ink is ejected from the nozzle 27 using a variation in the pressure of the ink.

Figure 5:
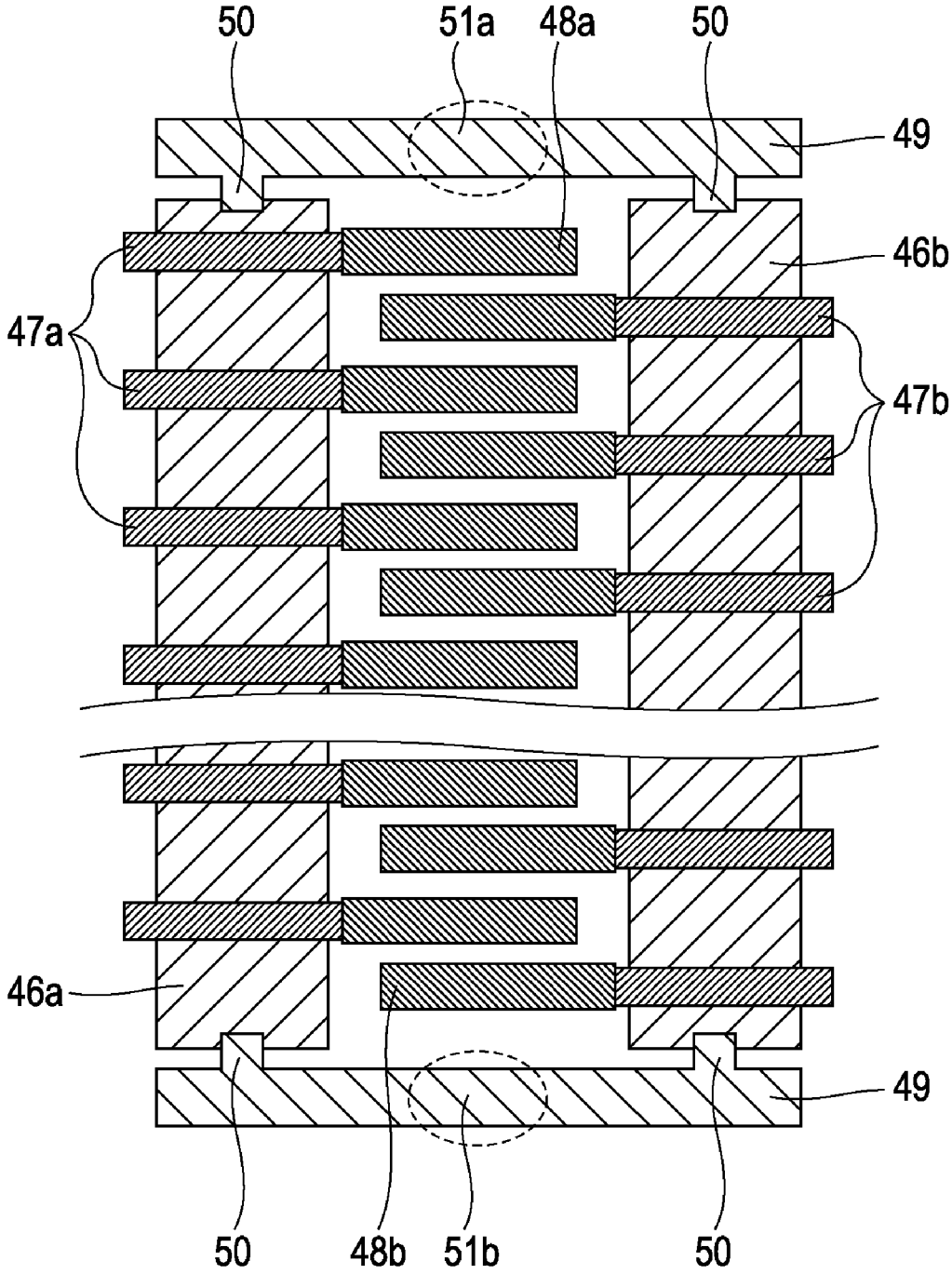
FIG. 5 is a schematic diagram illustrating a layout of an element electrode wiring portion and an element electrode of a piezoelectric element.

FIG. 5 is a schematic diagram illustrating a layout of the element electrode wiring portion extending from the element electrode and the element electrode of the piezoelectric element 35. Further, in the same drawing, the dark hatching portion indicates the individual element electrode 47 and the individual element electrode wiring portion 48 connected thereto, and the light hatching portion indicates the common element electrode 46 and the common element electrode wiring portion 49 connected thereto. Further, in the same drawing, the longitudinal direction is the nozzle row direction (the piezoelectric element row direction), and the configuration for two rows of nozzles is shown. In the embodiment, platinum or gold is used as a material of the electrode film.

In the embodiment, the common element electrodes 46 (46*a* and 46*b*) commonly used with the piezoelectric elements 35 are continuously formed on the elastic film 30 defining a part of the pressure chamber 31 in the nozzle row direction so as to have a rectangular shape when seen in a plan view in the same direction. Then, a piezoelectric body layer (not shown) and the individual element electrodes 47 (47*a* and 47*b*) are sequentially laminated thereon so as to be patterned for each of the piezoelectric elements 35. The dimension in the length direction of the individual element electrode 47 is set to be slightly longer than the width in the short length direction of the common element electrode 46. In addition, the dimension of the width direction (the short length direction) of the individual element electrode 47 can be set to be equal to the width of the pressure generating element 35. The individual element electrode terminal 48 (which is one kind of the individual element electrode wiring portion) is formed between the adjacent nozzle rows so as to have a reed shape in the plan view and to be connected to the individual element electrode 47 so as to correspond to each of the individual element electrodes 47. The dimensions of the long length direction of the individual element electrode terminal 48 are set to a length so as not to contact the peripheral common element electrode 46. Further, the dimension of the width direction (the short length direction) of the individual element electrode terminal 48 may be set to be equal to the dimension of the width of the individual element electrode 47. Then, the individual element electrode terminal 48*a* corresponding to one nozzle row (on the left side of the drawing) and the individual element electrode terminal 48*b* corresponding to the other nozzle row (on the right side of the drawing) are arranged in a row shape while deviating from each other at the same interval in the nozzle row direction. The individual element electrode terminal 48 is a portion that is electrically connected to the one-end-side individual electrode wiring terminal 53 (refer to FIGS. 6A and 6B) on one end side of a first cable 39*a* of the flexible cable 39.

Further, the common element electrode portion 49 (which is one kind of common element electrode wiring portion) is formed on both sides of the nozzle row direction of each of the common element electrodes 46*a* and 46*b*. The common element electrode portion 49 extends across the common element electrodes 46*a* and 46*b* respectively corresponding to the nozzle rows in a direction perpendicular to the nozzle row direction, and serves as the electrode wiring portion commonly used with the common element electrodes 46*a* and 46*b*. In addition, the common element electrode portion 49 is connected to each of the common element electrodes 46 via a branch electrode portion 50. Further, in the common element electrode portion 49, a portion located on both sides in the arrangement direction of the individual element electrode terminals 48, that is, the portion circled by the dashed line in FIG. 5 indicates the common element electrode terminal 51 bonded to the common electrode wiring terminal 78 on one end side of the flexible cable.

Figure 6A:
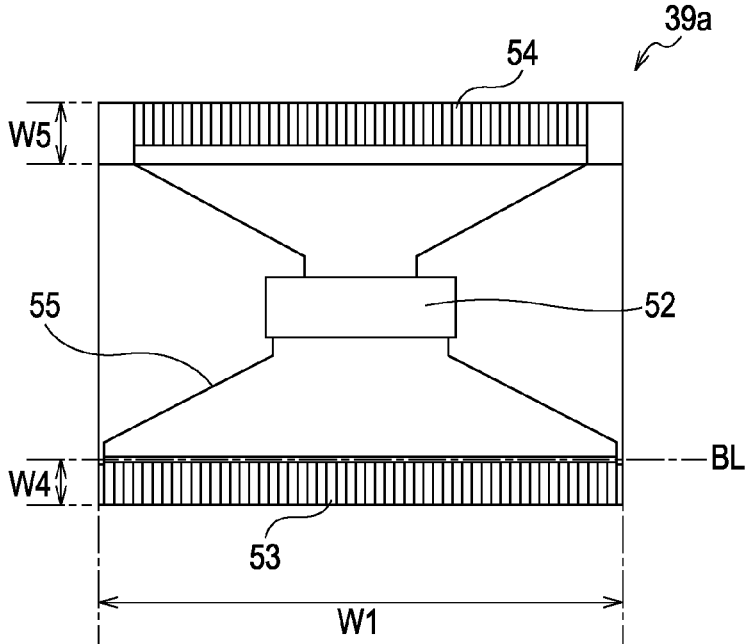
FIGS. 6A and 6B are diagrams illustrating a configuration of a flexible cable.
Figure 6B:
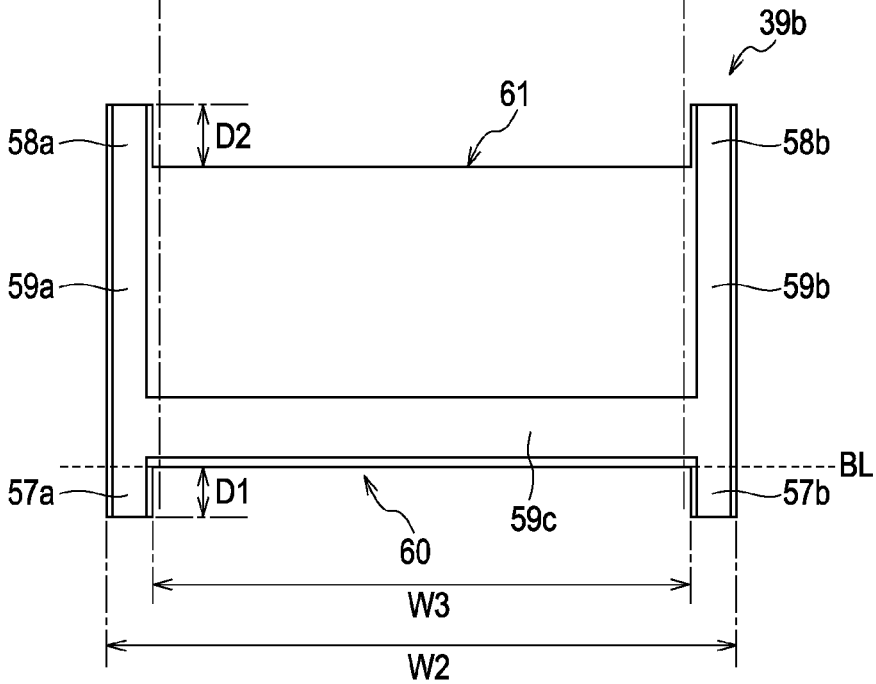

FIGS. 6A and 6B are diagrams illustrating a configuration of the flexible cable 39 (which is one kind of the wiring member with regards to the invention). The flexible cable 39 according to the invention is constituted by a first cable 39*a* (which is one kind of the first wiring member) shown in FIG. 6A and a second cable 39*b* (which is one kind of second wiring member) shown in FIG. 6B, where the first and second cables make a pair, and are used while overlapping with each other.

The first cable 39*a* has a structure in which a control IC 52 is mounted on one surface of a rectangular base film such as polyimide so as to control the application of the driving voltage to the piezoelectric element 35, and a pattern of the individual electrode wiring 55 connected to the control IC 52 is formed thereon. Further, a plurality of one-end-side individual electrode wiring terminals 53 is arranged on one end portion (the lower end portion of FIGS. 6A and 6B) of the first cable 39*a* so as to respectively correspond to the individual element electrode terminals 48 of the actuator unit. Then, a plurality of the other-end-side individual electrode wiring terminals 54 is arranged on the other end portion (the upper end portion of FIGS. 6A and 6B) thereof so as to be connected to a substrate terminal portion of a substrate (not shown) relaying a signal from the printer body. Then, the surface of the control IC 52 or a wiring pattern other than the wiring terminals 53 and 54 of both end portions of the first cable 39*a* is covered by a resist.

The second cable 39*b* is a wiring member in which a pattern of the common electrode wiring 59 is formed on one surface of a base film having a width W2 (the width in the direction corresponding to the arrangement direction of the individual electrode wiring terminals) larger than a width W1 of the first cable 39*a*. In addition, the dimension of the vertical direction (the direction perpendicular to the terminal arrangement direction) of the second cable 39*b* may be set to be equal to the dimension of the vertical direction of the first cable 39*a*. One-end-side common electrode wiring terminals 57*a* and 57*b* are formed on both sides in the width direction of one end portion of the second cable 39*b* so as to correspond to the common element electrode terminal 51 of the actuator unit. In addition, a portion away from the one-end-side common electrode wiring terminal 57, that is, a portion between the left and right one-end-side common electrode wiring terminals 57*a* and 57*b* at the one end portion is provided with a one-end-side notch portion 60 that is notched in a rectangular shape from one end side toward the other end side. The width W3 of the one-end-side notch portion 60 is set to be equal to or slightly larger than the width W1 of the first cable 39*a*. In addition, the notch depth D1 of the one-end-side notch portion 60 is set to be equal to or slightly larger than the width W4 of the one-end-side individual electrode wiring terminal 53 of the one end portion of the first cable 39*a*.

The other-end-side common electrode wiring terminals 58*a* and 58*b* connected to the substrate terminal portion of the substrate are formed on both sides in the width direction of the other end portion of the second cable 39*b*. A portion away from the other-end-side common electrode wiring terminal 58, that is, a portion between the left and right other-end-side common electrode wiring terminals 58*a* and 58*b* at the other end portion is provided with the other-end-side notch portion 61 that is notched in a rectangular shape from the other end side toward the one end side. The width of the other-end-side notch portion 61 may be set to be equal to the width W3 of the one-end-side notch portion 60. In addition, the depth D2 of the other-end-side notch portion 61 is set to be equal to or slightly larger than the width W5 of the other-end-side individual electrode wiring terminal 54 of the other end portion of the first cable 39*a* in the transverse direction. The common electrode wiring 59 is formed in a substantially H-shape and includes common electrode vertical wirings 59*a* and 59*b* which are formed on both sides in the width direction of the cable so as to connect the one-end-side common electrode wiring terminal 57 to the other-end-side common electrode wiring terminal 58, and a common electrode transverse wiring 59*c* which connects the common electrode vertical wirings 59*a* and 59*b*. The common electrode wiring 59 is not connected to the control IC 52, and is connected to the ground wire of the printer 1. Then, a portion other than the wiring terminals 57*a*, 57*b*, 58*a*, and 58*b* of the second cable 39*b* is covered by a resist.

In order to align both end portions of the first and second cables 39*a* and 39*b* while one surface as the wiring terminal formation surface faces the same side, the one-end-side individual electrode wiring terminal 53 of the first cable 39*a* is disposed inside the one-end-side notch portion 60 of the second cable 39*b*, and the other-end-side individual electrode wiring terminal 54 of the first cable 39*a* is disposed inside the other-end-side notch portion 61. In this state, the one-end-side common electrode wiring terminals 57*a* and 57*b* of the second cable 39*b* are disposed on the outside (both sides) of the arrangement direction of the one-end-side individual electrode wiring terminal group of the first cable 39*a*. In the same way, the other-end-side common electrode wiring terminals 58*a* and 58*b* of the second cable 39*b* are disposed on the outside in the arrangement direction of the other-end-side individual electrode wiring terminal group of the first cable 39*a*.

During the wiring operation to the actuator unit, the wiring terminal, the wiring pattern, or the like is formed at the bending line BL virtually set between the wiring terminal formation area and the wiring pattern formation area in the one end portions of the cables 39*a* and 39*b*, and the one end portions are bent at the substantially right angle toward the other surface on the opposite side thereof (refer to FIGS. 3 and 4). In this state, the portions provided with the wiring terminals 53 and 57 respectively face the element electrode terminals 48 and 51 on the actuator unit when being attached to the actuator unit. Each of the wiring terminals 53 and 57 is subjected to solder plating in advance. The wiring terminals 58 and 59 are soldered to the corresponding element electrode terminals 48 and 51 on the actuator unit so as to be electrically connected thereto, and the flexible cable 39 is attached to the actuator unit. That is, the individual electrode wiring terminal 53 of one end side of the first cable 39*a* is connected to the corresponding individual element electrode terminal 48 on the actuator unit. Then, the one-end-side common electrode wiring terminals 57*a* and 57*b* of the second cable 39*b* are respectively connected to the corresponding common element electrode terminals 51*a* and 51*b* on the actuator unit. Further, the wiring terminals 54 and 58 are soldered to the corresponding substrate terminals of the substrate so as to be electrically connected thereto.

Figure 7:
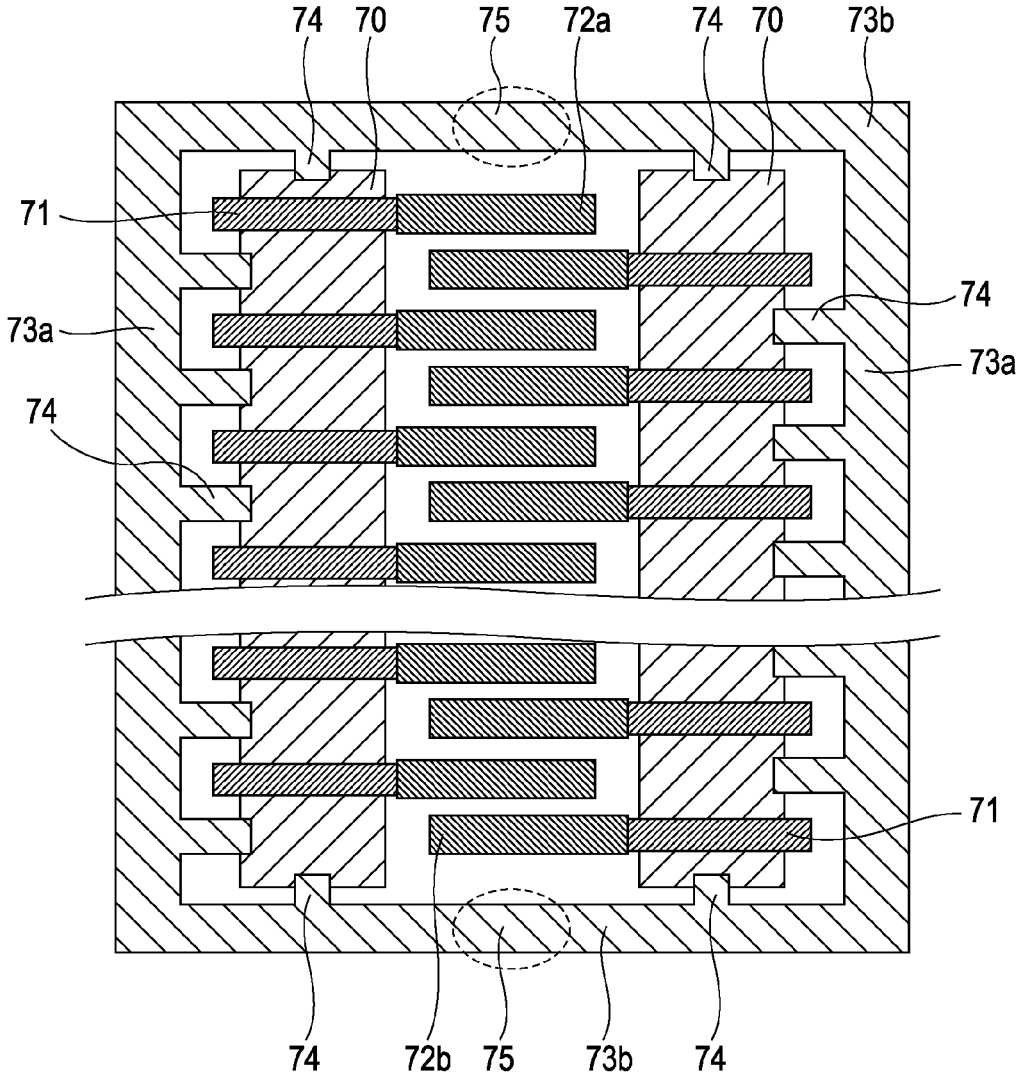
FIG. 7 is a schematic diagram illustrating a layout of an element electrode wiring portion and an element electrode of a piezoelectric element of an existing printing head.
Figure 8:
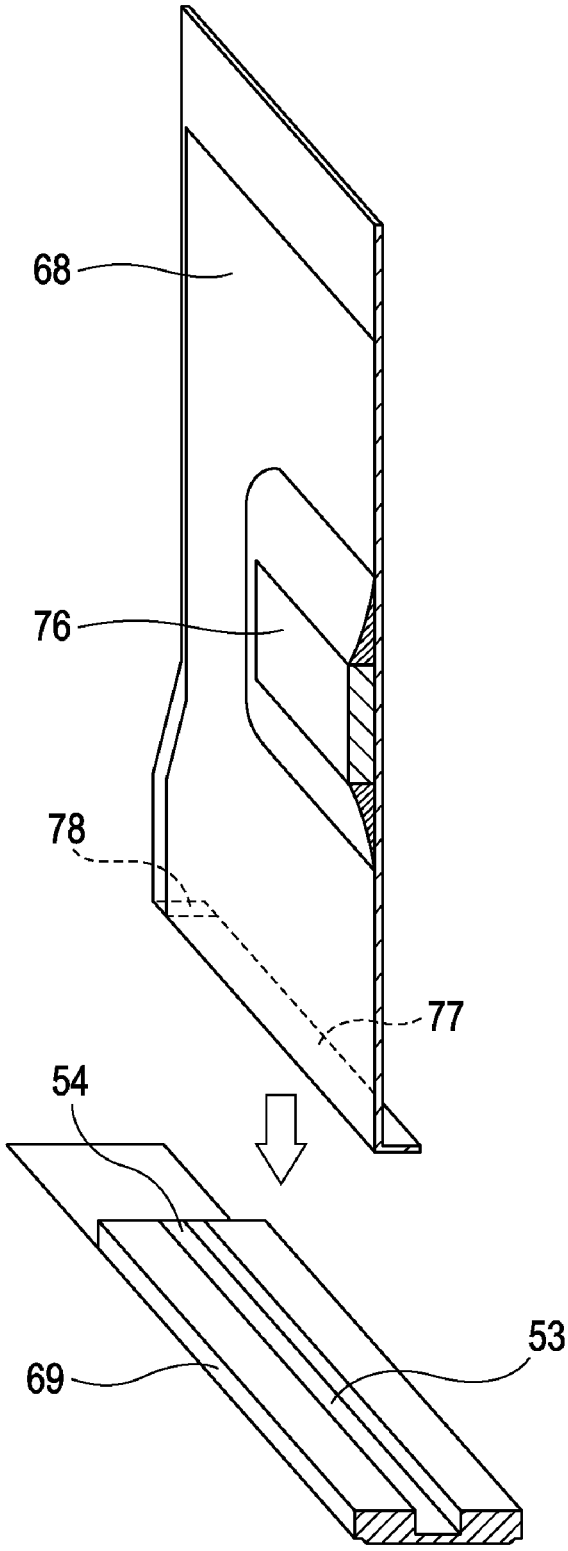
FIG. 8 is a perspective view illustrating a configuration of an existing actuator unit and an existing flexible cable.

In this way, the flexible cable 39 includes the first cable 39*a* and the second cable 39*b*. The first cable 39*a* is provided with the individual electrode wiring terminals 53 and 54, the individual electrode wiring 55, and the control IC. The second cable 39*b* is provided with only the common electrode wiring terminals 57 and 58 and the common electrode wiring 59. Accordingly, it is possible to secure a larger formation area for the common electrode wiring 59 in the second cable 39*b* than that of existing wiring members. Therefore, it is possible to suppress a decrease in the voltage in the common electrode while simultaneously ejecting the ink from the plurality of nozzles 27. Further, it is possible to reduce the area of the common element electrode portion of the actuator unit by the same amount as the formation area is increased. That is, for example, the common vertical electrode portions (reference numeral 73*a* in FIG. 7) arranged in the nozzle row direction and required to prevent a decrease in the voltage in existing printing heads are not necessary for the printing head 3 according to the invention. Accordingly, it is possible to contribute to a decrease in the size of the printing head 3.

Further, the notch portions 60 and 61 are formed at both end portions of the second cable 39*b*, and the wiring terminals 53 and 54 of the first cable 39*a* inside the notch portions 60 and 61 when overlapping the cables with each other are respectively disposed inside the notch portions 60 and 61. Accordingly, it is possible to arrange the individual electrode wiring terminal group and the common electrode wiring terminal on the same row. Therefore, it is possible to simultaneously and easily perform the bonding of the wiring terminals and the element terminals of the actuator unit at the one end portion of the cable, and to simultaneously perform the bonding of the wiring terminals and the substrate terminals at the other end portion of the cable. Further, since both end portions of the first cable 39*a* and both end portions of the second cable 39*b* do not overlap with each other, it is possible to easily perform the bending thereof during the wiring operation.

Furthermore, in the above-described embodiment, the ink jet printing head 3 as one kind of liquid ejecting head has been described as an example, but the invention may be applied to other liquid ejecting heads having a configuration in which a driving voltage is supplied to a pressure generating element via a flexible cable. For example, the invention may be applied to a color material ejecting head used to manufacture a color filter such as a liquid crystal display, an electrode material ejecting head used to form electrodes such as an organic EL (electro-luminance) display and an FED (field emission display), a biological organic material ejecting head used to manufacture a biochip (a biochemical element), and the like.

What is claimed is:

1. A liquid ejecting head wiring member that supplies a driving voltage to an actuator unit of a liquid ejecting head which includes a plurality of pressure generating elements ejecting a liquid from a nozzle communicating with a pressure chamber by causing a variation in the pressure of the liquid inside the pressure chamber in accordance with the application of the driving voltage between an individual element electrode and a common element electrode, the liquid ejecting head wiring member comprising:

a first wiring member which includes a plurality of one-end-side individual electrode wiring terminals formed at one end portion thereof so as to respectively correspond to the individual element electrode terminals of the pressure generating elements and individual electrode wirings formed so as to respectively correspond to the individual electrode wiring terminals; and a second wiring member which includes one-end-side common electrode wiring terminals formed at one end portion thereof so as to respectively correspond to common element electrode terminals of the pressure generating elements and common electrode wirings formed so as to respectively correspond to the one-end-side common electrode wiring terminals, and has a width in the direction corresponding to the arrangement direction of the individual electrode wiring terminals larger than that in the arrangement direction of the individual electrode wiring terminals of the first wiring member, wherein the first wiring member and the second wiring member overlap with each other so that wiring terminal formation surfaces face the same side and the one-end-side common electrode wiring terminals are located on the outside of the arrangement direction of the wiring terminals of the group of the one-end-side individual electrode wiring terminals, one end portions thereof are bent in the same direction so that the wiring terminals respectively face the element terminals of the pressure generating elements, and then the wiring terminals are respectively bonded to the corresponding element terminals.

2. The liquid ejecting head wiring member according to claim 1, wherein the second wiring member includes a one-end-side notch portion which is formed at a position away from the one-end-side common electrode wiring terminals at the one end portion so as to be partially notched from one end side toward the other end side, and wherein the group of the one-end-side individual electrode wiring terminals is disposed inside the one-end-side notch portion while the first and second wiring members overlap with each other.

3. The liquid ejecting head wiring member according to claim 1, wherein the other end portion of the first wiring member is provided with a plurality of the other-end-side individual electrode wiring terminals, wherein the other end portion of the second wiring member is provided with the other-end-side common electrode wiring terminal and the other-end-side notch portion which is formed at a position away from the other-end-side common electrode wiring terminal so as to be partially notched from the other end side toward one end side, and wherein the group of the other-end-side individual electrode wiring terminals is disposed in the other-end-side notch portion while the first and second wiring members overlap with each other.

4. A liquid ejecting head that applies a driving voltage to a pressure generating element via a liquid ejecting head wiring member, wherein the liquid ejecting head comprises:

an actuator unit which includes a plurality of the pressure generating elements ejecting a liquid from a nozzle communicating with a pressure chamber by causing a variation in the pressure of the liquid inside the pressure chamber in accordance with the application of the driving voltage between an individual element electrode and a common element electrode;

an individual element electrode connection portion which is electrically connected to the individual element electrode; and a common element electrode connection portion which is electrically connected to the common element electrode, wherein the individual element electrode connection portion is connected to an individual electrode wiring terminal corresponding to the first wiring member, and wherein the common element electrode connection portion is connected to a common electrode wiring terminal corresponding to the second wiring member.

5. The liquid ejecting head in accordance with claim 4, wherein the liquid ejecting head wiring member comprises:

a first wiring member which includes a plurality of one-end-side individual electrode wiring terminals formed at one end portion thereof so as to respectively correspond to the individual element electrode terminals of the pressure generating elements and individual electrode wirings formed so as to respectively correspond to the individual electrode wiring terminals; and a second wiring member which includes one-end-side common electrode wiring terminals formed at one end portion thereof so as to respectively correspond to common element electrode terminals of the pressure generating elements and common electrode wirings formed so as to respectively correspond to the one-end-side common electrode wiring terminals, and has a width in the direction corresponding to the arrangement direction of the individual electrode wiring terminals larger than that in the arrangement direction of the individual electrode wiring terminals of the first wiring member, wherein the first wiring member and the second wiring member overlap with each other so that wiring terminal formation surfaces face the same side and the one-end-side common electrode wiring terminals are located on the outside of the arrangement direction of the wiring terminals of the group of the one-end-side individual electrode wiring terminals, one end portions thereof are bent in the same direction so that the wiring terminals respectively face the element terminals of the pressure generating elements, and then the wiring terminals are respectively bonded to the corresponding element terminals.

6. The liquid ejecting head in accordance with claim 5, wherein the second wiring member includes a one-end-side notch portion which is formed at a position away from the one-end-side common electrode wiring terminals at the one end portion so as to be partially notched from one end side toward the other end side, and wherein the group of the one-end-side individual electrode wiring terminals is disposed inside the one-end-side notch portion while the first and second wiring members overlap with each other.

7. Liquid ejecting head in accordance with claim 5, wherein the other end portion of the first wiring member is provided with a plurality of the other-end-side individual electrode wiring terminals, wherein the other end portion of the second wiring member is provided with the other-end-side common electrode wiring terminal and the other-end-side notch portion which is formed at a position away from the other-end-side common electrode wiring terminal so as to be partially notched from the other end side toward one end side, and wherein the group of the other-end-side individual electrode wiring terminals is disposed in the other-end-side notch portion while the first and second wiring members overlap with each other.

8. A liquid ejecting apparatus comprising:

a liquid ejecting head that applies a driving voltage to a pressure generating element via a liquid ejecting head wiring member, the liquid ejecting head comprising:

an actuator unit which includes a plurality of the pressure generating elements ejecting a liquid from a nozzle communicating with a pressure chamber by causing a variation in the pressure of the liquid inside the pressure chamber in accordance with the application of the driving voltage between an individual element electrode and a common element electrode;

an individual element electrode connection portion which is electrically connected to the individual element electrode; and a common element electrode connection portion which is electrically connected to the common element electrode, wherein the individual element electrode connection portion is connected to an individual electrode wiring terminal corresponding to the first wiring member, and wherein the common element electrode connection portion is connected to a common electrode wiring terminal corresponding to the second wiring member.

9. The liquid ejecting apparatus in accordance with claim 8, wherein the liquid ejecting head wiring member comprises:

a first wiring member which includes a plurality of one-end-side individual electrode wiring terminals formed at one end portion thereof so as to respectively correspond to the individual element electrode terminals of the pressure generating elements and individual electrode wirings formed so as to respectively correspond to the individual electrode wiring terminals; and a second wiring member which includes one-end-side common electrode wiring terminals formed at one end portion thereof so as to respectively correspond to common element electrode terminals of the pressure generating elements and common electrode wirings formed so as to respectively correspond to the one-end-side common electrode wiring terminals, and has a width in the direction corresponding to the arrangement direction of the individual electrode wiring terminals larger than that in the arrangement direction of the individual electrode wiring terminals of the first wiring member, wherein the first wiring member and the second wiring member overlap with each other so that wiring terminal formation surfaces face the same side and the one-end-side common electrode wiring terminals are located on the outside of the arrangement direction of the wiring terminals of the group of the one-end-side individual electrode wiring terminals, one end portions thereof are bent in the same direction so that the wiring terminals respectively face the element terminals of the pressure generating elements, and then the wiring terminals are respectively bonded to the corresponding element terminals.

10. The liquid ejecting apparatus in accordance with claim 9, wherein the second wiring member includes a one-end-side notch portion which is formed at a position away from the one-end-side common electrode wiring terminals at the one end portion so as to be partially notched from one end side toward the other end side, and wherein the group of the one-end-side individual electrode wiring terminals is disposed inside the one-end-side notch portion while the first and second wiring members overlap with each other.

11. A liquid ejecting apparatus in accordance with claim 9, wherein the other end portion of the first wiring member is provided with a plurality of the other-end-side individual electrode wiring terminals, wherein the other end portion of the second wiring member is provided with the other-end-side common electrode wiring terminal and the other-end-side notch portion which is formed at a position away from the other-end-side common electrode wiring terminal so as to be partially notched from the other end side toward one end side, and wherein the group of the other-end-side individual electrode wiring terminals is disposed in the other-end-side notch portion while the first and second wiring members overlap with each other.

* * * * *